US006602566B2

(12) United States Patent
Steenbergen

(10) Patent No.: US 6,602,566 B2
(45) Date of Patent: Aug. 5, 2003

(54) METHOD FOR APPLYING A REMOVABLE PRINTED MARKING TO A CONTAINER

(75) Inventor: Johannes Femminus Steenbergen, Ommen (NL)

(73) Assignee: Heineken Technical Services B.V., Amsterdam (NL)

( * ) Notice: Subject to any disclaimer, the term of this patent is extended or adjusted under 35 U.S.C. 154(b) by 0 days.

(21) Appl. No.: 09/964,313

(22) Filed: Sep. 26, 2001

(65) Prior Publication Data

US 2002/0011157 A1 Jan. 31, 2002

Related U.S. Application Data

(62) Division of application No. 09/125,552, filed as application No. PCT/NL97/00093 on Feb. 27, 1997.

(30) Foreign Application Priority Data

Mar. 1, 1996 (NL) ..... 1002508

(51) Int. Cl.[7] ..... B41C 1/06

(52) U.S. Cl. ..... 428/35.7; 428/483; 428/516; 428/522

(58) Field of Search ..... 428/35.7, 483, 428/516, 522

(56) References Cited

U.S. PATENT DOCUMENTS

| | | | | |
|---|---|---|---|---|
| 4,444,839 A | | 4/1984 | Dudzik et al. | 428/336 |
| 5,094,912 A | * | 3/1992 | Deibig et al. | 428/355 |
| 5,320,693 A | | 6/1994 | Helf | 156/71 |
| 5,335,596 A | | 8/1994 | DeMoore et al. | 101/350 |
| 5,925,208 A | * | 7/1999 | Dronzek | 156/257 |

FOREIGN PATENT DOCUMENTS

| | | |
|---|---|---|
| DE | 20 43 486 A | 3/1971 |
| DE | 44 33 006 A | 3/1996 |
| EP | 0 019 977 A | 12/1980 |
| EP | 0 049 483 A | 4/1982 |
| EP | 0 316 676 A | 5/1989 |
| EP | 0 326 039 A | 8/1989 |
| GB | 2 259 291 A | 3/1993 |

* cited by examiner

*Primary Examiner*—Sandra M. Nolan
(74) *Attorney, Agent, or Firm*—Pearne & Gordon LLP

(57) ABSTRACT

For the application of a removable printing to a container, such as a plastic crate, a layer of ink, which forms the printing and is provided on one side with a bonding agent for bonding the layer of ink to the container, is transferred to the container from a carrier film to which the layer of ink has been applied to the side not provided with bonding agent. The bonding agent has such properties that in normal conditions of use of the container the layer of ink adheres firmly to the container and in predetermined conditions which differ from the conditions of use the bonding agent and the layer of ink are easy to remove from the container. This produces a container with a high-quality printing, which printing is easy to replace with another printing.

10 Claims, No Drawings

METHOD FOR APPLYING A REMOVABLE PRINTED MARKING TO A CONTAINER

This application is a divisional application of U.S. patent application Ser. No. 09/125,552 which was filed on Feb. 1, 1999 and claimed priority under 35 USC 371 from PCT/NL97/00093, filed Feb. 27, 1997, which PCT application claimed priority under 35 USC 119 from Netherlands application 1002508, filed Mar. 1, 1996.

FIELD OF THE INVENTION

The invention relates to a method for applying a removable printing to a container.

BACKGROUND OF THE INVENTION

Applying a printing to a container, for example a bottle crate, is generally known. The printing can be applied to the container by flexographic printing or screen printing techniques. However, such a printing is of a permanent character and cannot be removed from the container, or can be removed only by very special measures.

In practice, there is a need for applying a different printing to a certain type of container (for example, if a different product is to be packed therein, or in the case of advertising promotions). For this purpose, the printing on the container must be relatively easy to remove from it without the container being damaged. On the other hand, the printing must be durable and of good optical quality, in order to ensure that a container can be used for a specific brand of product for quite a long period of time.

Labels which can be affixed to containers and removed from them again are known. Such labels contain a paper, aluminium or plastic film which is provided with a special layer of bonding agent. However, a container provided with such a label does not have a perfect appearance. Moreover, the thickness of such labels invites undesirable removal. During the industrial removal of labels from a large number of containers a relatively large quantity of material comes off and requires further processing.

SUMMARY OF INVENTION

The object of the invention is to provide a method which makes it possible to apply an optically pleasing printing to a container, which printing is difficult for the user to remove from the container, but is easy to remove from the container industrially, the container being clean again after the printing has been removed, so that a new printing can be applied.

This object is achieved according to the invention by a method for applying a removable printing to a container, in which a layer of ink, which forms the printing and is provided on one side with a bonding agent for bonding the layer of ink to the container, is transferred to the container from a carrier film to which the layer of ink has been applied at the side not provided with bonding agent, the bonding agent having such properties that in normal conditions of use of the container the layer of ink adheres firmly to the container and in predetermined conditions which differ from the conditions of use the bonding agent and the layer of ink are easy to remove from the container.

Use of the method according to the invention produces a container with a high-quality printing which is relatively easy to replace by another printing.

The invention also relates to a plastic container provided with a removable printing comprising a layer of ink which forms the printing, which layer of ink is applied to the container by means of a bonding agent, the bonding agent having such properties that in normal conditions of use of the container the printing adheres firmly to the container and in predetermined conditions which differ from the conditions of use the bonding agent and the layer of ink are easy to remove from the container.

The invention also relates to a film to which a layer of ink which forms the printing is applied to one side, which-layer of ink on the side facing away from the film is provided with a bonding agent for bonding the layer of ink to a substrate.

Preferred embodiments of the method, the plastic container and the film according to the invention are defined in the subclaims.

DETAILED DESCRIPTION OF THE PREFERRED EMBODIMENTS OF THE INVENTION

The invention will be explained in greater detail with reference to the exemplary embodiment below.

The exemplary embodiment relates to the application of a removable printing to a plastic bottle crate which is preferably made of a polyalkene, such as polyethylene or polypropylene, and in which the printing is applied to the outside wall of the crate. However, the method according to the invention can also be used for other types of containers, such as plastic boxes and glass or plastic bottles.

When the method according to the invention is applied to a clean crate, a layer of ink, which forms the printing and is provided on one side with a bonding agent for bonding the layer of ink to the crate, is transferred from a carrier film to the crate. The layer of ink is applied to a carrier film at the side not provided with a bonding agent. The carrier film is preferably a calendered PET, polypropylene or polyethylene film with a thickness of 40–50 $\mu$m.

If the printing is being applied on an industrial scale, the printing will generally come from a carrier film web to which several layers of ink which form the printing have been applied. If the carrier film web has been placed on a roll, the side not provided with the printing will preferably be provided with an anti-bonding layer, for example a silicone layer. The printing will preferably be applied mechanically to the crates.

In order to be able to guarantee a perfect appearance and good protection of the printing, the layer of ink can be provided with a layer of lacquer on the side not provided with a bonding agent. Consequently, when the layer of ink has been applied to the carrier film, the layer of lacquer will be situated between the layer of ink and the carrier film. In order to guarantee optimum protection of the printing on a crate, the layer of lacquer projects beyond the contours of the layer of ink and is likewise provided with a bonding agent in that region, preferably the same bonding agent as that also applied to the layer of ink. Once the printing has been applied to the crate, the layer of ink is completely enclosed between the wall of the crate and the layer of lacquer.

In order to be able to remove the printing from the crate again relatively easily, the bonding agent has such properties that in normal conditions of use of the crate the layer of ink and the layer of lacquer adhere firmly to the crate and in predetermined conditions which differ from the conditions of use the bonding agent, the layer of ink and the layer of lacquer are easy to remove from the crate. An example is a bonding agent which loses its adhesion to the crate at a temperature which is higher than the temperature at which crates are usually cleaned. Crates are generally cleaned with water at a temperature of approximately 40° C. By using a bonding agent which becomes ineffective at a temperature of approximately 60° C. and higher, it is possible to allow crates from which the printing is to be removed to soak for some time in water at 60° C. and higher (to which an agent for reducing the surface tension has been added if necessary) and then to remove the printing using a high-pressure water jet (for example 15 bar).

In order to accelerate the soaking process, a slightly porous layer of ink and layer of lacquer, if present, can be used, so that water can penetrate rapidly to the bonding agent.

It is also possible to use a bonding agent which becomes ineffective under the influence of UV rays. In that case also, the printing can be removed using a high-pressure water jet.

The printing can be applied to the carrier film by means of conventional printing techniques, such as flexographic printing or screen printing techniques. This also applies to the layer of lacquer. In practice, a layer of lacquer will first be applied to the carrier film, with such dimensions that said layer of lacquer projects slightly beyond the layer of ink to be applied subsequently. The layer of ink will then be applied to the layer of lacquer and, finally, a bonding agent will be applied to the layer of ink and the part of the layer of lacquer projecting beyond the layer of ink, likewise using printing techniques.

The bonding between the layer of ink or layer of lacquer and the carrier film must, of course, be weaker than the bonding which the bonding agent produces between the layer of ink and layer of lacquer and the crate. This means that the layer of ink is easy to transfer from the carrier film to the crate without the layer of ink or the layer of lacquer being damaged. The bonding between the layer of ink or the layer of lacquer and the carrier film is the result of adhesion between the layer of ink or layer of lacquer and the carrier film.

As already mentioned, the layer of ink will generally be transferred mechanically from the carrier film to the crate. It must be ensured in this case that the layer of ink is pressed down well on the substrate, and that no air inclusions arise between the layer of ink and the crate wall.

The result of the application of the method according to the invention is a crate with a printing of very high quality, but which can easily be removed again, in such a way that after the removal of the printing the surface of the crate is undamaged, and a new printing can be applied to the crate.

Good results are obtained in practice with a dispersion glue manufactured by KIWO, known by the name of D 3206 VP, as the bonding agent. Of course, the invention is not limited to this bonding agent.

What is claimed is:

1. Plastic container provided with a removable printing comprising a layer of ink which forms the printing and which is applied directly to the container by means of an adhesive, the adhesive having such properties that in normal conditions of use of the container the printing adheres firmly to the container and in predetermined conditions which differ from the normal conditions of use the layer of ink and the adhesive are easy to remove from the container.

2. Plastic container according to claim 1, in which a layer of lacquer is applied over the layer of ink and a region immediately next to the layer of ink.

3. Plastic container according to claim 1, in which the bonding between the adhesive and the container substantially disappears at a temperature which is higher than the temperature at which containers are usually cleaned.

4. Plastic container according to claim 3, in which the bonding between the adhesive and the container disappears at a temperature of approximately 60° C.

5. Plastic container according to claim 4, in which the container is a crate or box which is preferably made of a polyalkene, such as polyethylene or polypropylene, and the printing is applied to the outside wall of the crate or the box.

6. Film to which a layer of ink which forms a printing is applied to one side by means of conventional printing techniques, which layer of ink on the side facing away from the film is provided with an adhesive for bonding the layer of ink to a substrate.

7. Film according to claim 6, in which a layer of lacquer connected to the layer of ink is present between the layer of ink and the film.

8. Film according to claim 6, in which the film is in the form of a film web to which several layers of ink which form the printing have been applied.

9. Film according to claim 8, in which on the side not provided with a layer of ink the film is provided with an anti-bonding layer, for example a silicone layer.

10. A film according to claim 6, wherein the adhesive is in direct contact with the ink layer.

* * * * *